United States Patent [19]

Djordjevic et al.

[11] Patent Number: 4,709,679

[45] Date of Patent: Dec. 1, 1987

[54] MODULAR ACCUMULATOR INJECTOR

[75] Inventors: Ilija Djordjevic, Windsor; Marco Ganser, Granby, both of Conn.

[73] Assignee: Stanadyne, Inc., Windsor, Conn.

[21] Appl. No.: 715,354

[22] Filed: Mar. 25, 1985

[51] Int. Cl.[4] ..... E02M 39/00

[52] U.S. Cl. ..... 123/447; 123/506; 123/467; 239/585

[58] Field of Search ..... 123/447, 506, 458, 467; 239/585, 88–95

[56] References Cited

U.S. PATENT DOCUMENTS

| | | | |
|---|---|---|---|
| 3,187,733 | 6/1965 | Heintz | 123/447 |
| 4,080,942 | 3/1978 | Vincent | 123/447 |
| 4,091,771 | 5/1978 | Rapp | 123/447 |
| 4,513,719 | 4/1985 | Eodo | 123/447 |
| 4,545,352 | 10/1985 | Jourde | 123/447 |
| 4,546,749 | 10/1985 | Igashira | 123/458 |
| 4,563,133 | 1/1986 | Yasuhara | 123/458 |
| 4,612,893 | 9/1986 | Ishibashi | 123/447 |

*Primary Examiner*—Carl Stuart Miller

*Attorney, Agent, or Firm*—Chilton, Alix & Van Kirk

[57] ABSTRACT

An accumulator injector for injecting discrete pressurized charges of fuel has a modular-type configuration. An auxiliary accumulator pressure chamber in the form of a cap is threadably mounted to a main body member. A solenoid valve means for selectively releasing pressure from a control chamber to thereby trigger the injection of pressurized fuel is also removably mounted to the main body member.

21 Claims, 5 Drawing Figures

MODULAR ACCUMULATOR INJECTOR

BACKGROUND OF THE INVENTION

The present invention relates generally to accumulator injectors employed in fuel injection systems and relates more particularly to a new and improved accumulator nozzle fuel injection system providing improved control of both the fuel injection rate and the volume of the injected charge.

U.S. Pat. No. 4,566,416 entitled "ACCUMULATOR NOZZLE FUEL INJECTION SYSTEM", which patent is assigned to the assignee of the present invention, discloses an accumulator injector for a fuel injection system for a diesel engine. The disclosed accumulator injector has a fuel accumulator chamber connected to a fuel source by a passage having a restricted orifice. The pressure of the fuel source is controlled by an electronic controller. An injection valve control chamber is connected to the fuel source via a second passage having a restricted orifice. A solenoid valve which is controlled by the electronic controller is selectively energized to momentarily release pressure in the control chamber for injecting a charge of fuel from the accumulator chamber. The quantity of fuel in the fuel charge and the rate of injection of the fuel charge is determined by the fuel source pressure and the pulse width of the solenoid operating pulse.

The present invention is a new and improved accumulator injector having a modular form which incorporates many of the features of the foregoing accumulator injector of U.S. Pat. No. 4,566,416 to provide a new and improved accumulator nozzle fuel injection system for controlling the rate of fuel injection throughout the full speed and load range of the associated internal combustion engine. The present invention is particularly adaptable for use in engine applications wherein the available space for nozzle installation is limited. In accordance with the present invention, an accumulator injector having a modular configuration is employed to provide an efficient means for controlling the quantity of fuel in the fuel charge. The modular configuration reduces production costs because the modular configuration makes possible the use of common components for many different applications and injector configurations. The modular configuration also makes possible the efficient removal of the solenoid unit from the accumulator injector so that in the event of an electrical problem in the solenoid unit, the solenoid unit can be replaced with a new preadjusted solenoid unit without dismounting the entire accumulator injector from the engine and without requiring adjustment of the mounted injector.

The accumulator injector also incorporates means for varying both the accumulator pressure and the time interval of the injection for establishing the rate of fuel injection and the quantity of fuel in the injection charge. Means are also provided for terminating the fuel injection event rapidly and abruptly to thereby avoid the undesirable end of injection fuel dribble or fuel throttling which reduces combustion efficiency and increases combustion pollutants.

BRIEF SUMMARY OF THE INVENTION

Briefly stated, the invention in a preferred form is an accumulator injector for a fuel injection system which comprises a valve body which forms a control chamber, a bleed passage which leads from the control chamber and an accumulator passage. The valve body is adapted to receive fuel at rail pressure and transfer the fuel to the control chamber and the accumulator passage. A nozzle is mounted to the valve body. The nozzle comprises a plurality of discharge orifices, a valve seat and an elongated valve needle valve which is engageable with the valve seat in response to pressure in the control chamber to prevent the passage of fuel through the discharge orifices. The valve needle is axially shiftable from the seat for injecting pressurized fuel through the discharge orifices. An accumulator cap is removably mounted to the valve body for communication with the accumulator passage and the nozzle. The accumulator cap is of a modular form which may be selected from a plurality of selectively dimensioned caps so that an accumulator chamber is formed to provide a pre-established volume for a given application. A solenoid valve assembly is also removably mounted to the valve body to selectively vent the control chamber. Energization of the solenoid valve causes a release of pressure in the control chamber and the axial shifting of the valve needle to inject pressurized fuel through the discharge orifices.

In accordance with a preferred embodiment of the invention means are provided for accurately defining the displacement distance of the armature of the solenoid so that the solenoid valve may be efficiently removed from the accumulator injector unit and replaced with another solenoid valve while maintaining the accuracy and reliability of the accumulator injector.

An object of the invention is to provide a new and improved accumulator injector having a compact modular form wherein the injector exhibits favorable control of the injection rate and the quantity of fuel in the injected charge.

Another object of the invention is to provide a new and improved modular accumulator injector wherein the solenoid valve assembly may be relatively easily replaced with a pre-adjusted assembly without dismounting the accumulator injector unit from the engine and without requiring additional adjustment of the injector.

A further object of the invention is to provide a new and improved modular accumulator injector having an accumulator chamber partially defined by a modular member which is selected to provide a pre-established volume for the accumulator chamber.

Other objects and advantages will become apparent from the drawing and the specification.

DETAILED DESCRIPTION OF THE PREFERRED EMBODIMENT

Figure 1:
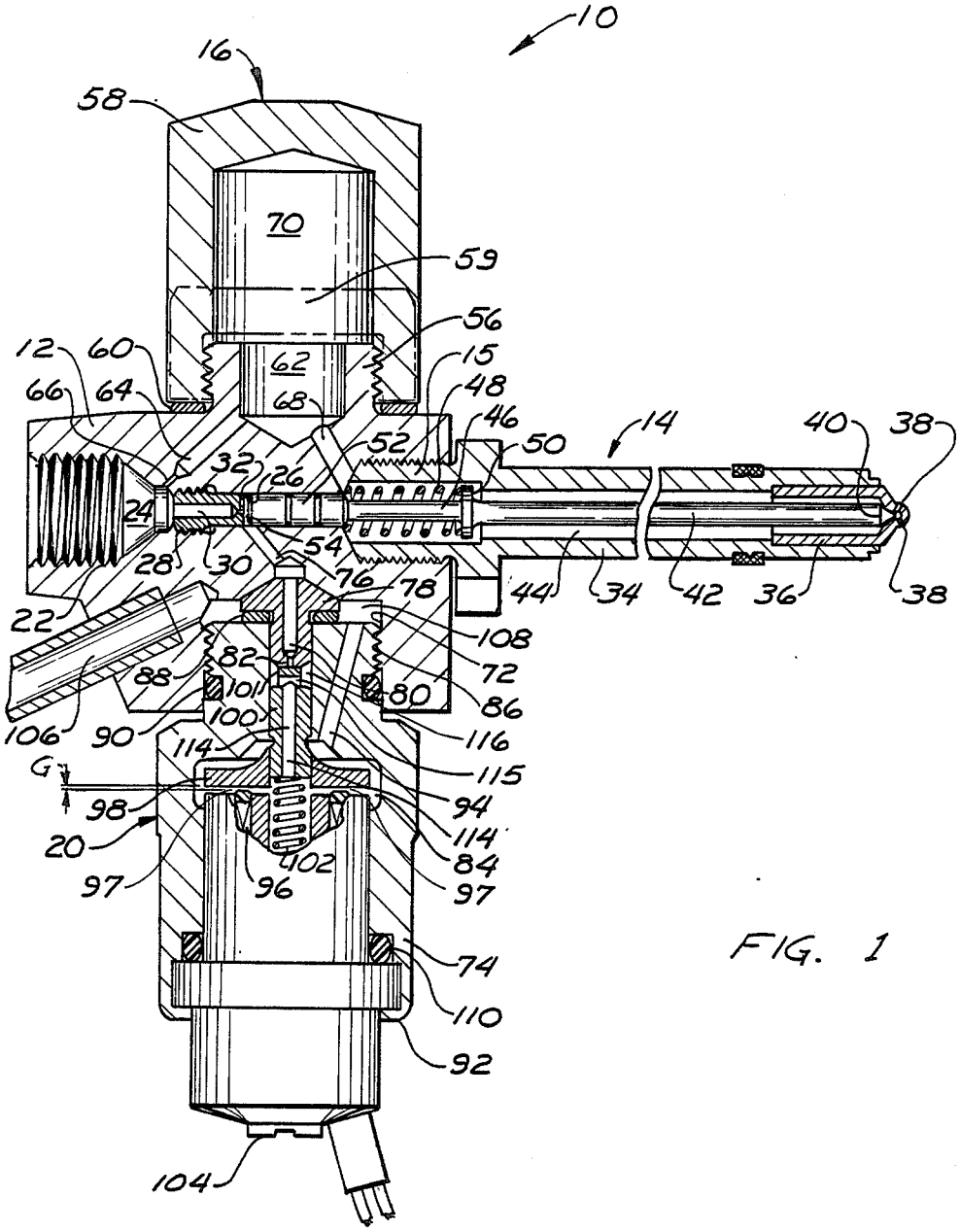
FIG. 1 is an axial sectional view, partly in section and partly broken away, of an accumulator injector in accordance with the present invention.

With reference to the drawing wherein like numerals represent like parts throughout the several FIGURES, an accumulator injector in accordance with the present invention is generally designated by the numeral 10. Accumulator injector 10 is of a modular-type configuration generally comprising a central main body 12 which mounts a nozzle 14, an accumulator 16 and a solenoid valve assembly 20. The accumulator injector 10 is employed in a fuel injection system (not illustrated) for injecting pressurized fuel into the combustion space of an internal combustion engine and has particular application in engines with limited available space for nozzle installation. An exemplary fuel injection system for which the accumulator injector may be incorporated is disclosed in U.S. Pat. No. 4,566,416.

Main body 12 includes an enlarged inlet bore 22 which tapers to a transition bore 24. Transition bore 24 opens into a control bore 26 having a uniform reduced diameter. The foregoing bores are axially aligned to form a bore extending transversely through the main body. An inlet insert 28 is threadably received in transition bore 24 and partially extends into control bore 26. Inlet insert 28 interiorly forms central longitudinal inlet passage 30 which opens into the control bore 26 via a restricted inlet orifice 32. Fuel under rail pressure is received at inlet bore 22 and passes through inlet passage 30 and inlet orifice 32 to control bore 26. Control bore 26 opens outwardly into an enlarged cavity which is threaded for receiving a complementary threaded base 15 of the nozzle 14.

Nozzle 14 includes a relatively thin elongated tubular housing 34 which interiorly receives at an outer end a nozzle head 36. Nozzle head 36 forms an outer tip which includes a plurality of discharge orifices 38. An interior portion of the nozzle head 36 forms a conical seat 40. The conical seat 40 is adapted for sealing engagement by the tip of an elongated valve needle 42 which is axially shiftable within the tubular housing 34. The sealing engagement of the valve needle 42 with the conical seat 40 prevents the passage of pressurized fuel from the nozzle through the discharge orifices 38.

The interior of tubular housing 34 forms an axially extending valve chamber 44 extending from the nozzle tip to the opposite mounting base portion of the nozzle. The mounting base 15 of the nozzle has a exterior cylindrical threaded surface for facilitating the threading mounting of the nozzle to the main body. The foregoing mounting configuration is employed in applications wherein the discharge orifices are symmetrically located about the central axis of the nozzle. Nozzle chamber 44 has an enlarged diameter in the base portion of the nozzle to accommodate a stem 46 of the valve needle and a spring 48. The relatively light compression spring 48 encircles stem 46 and is seated between the end wall of the main body mounting cavity and an integral flange 50 formed on the valve needle to bias the valve needle for sealing engagement against valve seat 40. A needle valve plunger 52 extends from stem 46 and is closely received in control bore 26. A variable control chamber 54 is essentially formed between the ends of plunger 52 and inlet insert 28 and the sides of the control bore 26.

An annular extension 56 of the main body has an exterior threaded surface which threadably mates with an interiorly threaded accumulator cap 58. A sealing ring 60 is interposed between the ends of the accumulator cap 58 to seal the cap in fluid tight relationship with the main body. An accumulator reservoir 62 is partially defined by the annular extension 56. An obliquely extending accumulator passage 64 provides fuel communication from the inlet bore 22 to the accumulator reservoir 62 via a restricted accumulator inlet orifice 66. A second oblique passage 68 extends from the accumulator 62 to provide fluid communication with the nozzle chamber 44. Cap 58 cooperates with reservoir 62 to interiorly define an auxiliary accumulator chamber 70 which provides an auxiliary chamber for storing or accumulating pressurized fuel delivered from the fuel inlet bore 22. Thus, the accumulator chamber for the accumulator injector 10 essentially comprises auxiliary chamber 70 nozzle chamber 44 and the connecting passage 68. Orifice 66 is dimensioned so that the flow to the accumulator chamber is substantially less than the rate of fuel injection through the discharge orifices during the injection event. The restricted orifices 32 and 66 also function to protect the control chamber 54 and the accumulator chamber, respectively, from any pressure surge or pressure wave at the fuel inlet which might otherwise adversely effect the fuel injection event.

In accordance with a feature of the present invention, the accumulator cap 58 may be selectively dimensioned to provide a pre-selected accumulator chamber volume. Because the accumulator cap is readily threadably removable, a plurality of various accumulator caps may be provided such as cap 59 illustrated in phantom in FIG. 1. The caps have various pre-selected dimensions so that an appropriately dimensioned cap mounted to the annular extension 56 of the main body provides a desired accumulator chamber volume for a given application. The volume of the accumulator chamber is substantially greater than the maximum volume of fuel injected by the injector throughout the entire speed and load range of the associated engine. The volume of the accumulator chamber is pre-established to obtain the desired relationship between the decrease in the accumulator pressure during the injection event and the volume of injected fuel to accurately control both the injection rate and the volume of injected fuel and to control the termination of the injection event without undesirable fuel dribble or fuel throttling.

The main body 12 includes a threaded bore 72 disposed generally opposite annular extension 56 to form a threaded female connector for receiving an adaptor sleeve 74. The inner portion of bore 72 is conically shaped. A bleed passage 76 obliquely leads from the control chamber 54 to the bore 72. A generally tapered poppet-shaped cylindrical insert 78 has a complementary frustoconical surface which seals with the interior conical surface of the main body for engaging the insert in fluid tight relationship with the main body. An alternate sealing interface between the main body 12 and insert 78 may be provided by complementary spherical surfaces or complementary surfaces which seal along a circular path. The interior stem portion of insert 78 forms a second axial bleed passage 80 to provide fluid communication with the first bleed passage 76. A restricted bleed orifice 82 is disposed at the end of the second bleed passage. An obliquely extending return conduit 106 leads from bore 72 through a portion of the main body for returning released fuel at low pressure to the fuel reservoir.

Adaptor sleeve 74 includes a central axial bore for closely receiving the stem passage defining portion of insert 78. Adaptor sleeve 74 includes a threaded base 86 which threadably engages with the threads of bore 72 for securely mounting the adaptor sleeve to the main body with the insert member 78 being securely intermediately positioned between the ends of the base and the bore. An annular shim 88 encircles the stem of insert 78 and engages between the flared portion of the insert and the end of the base to provide a precise pre-established spaced relationship for the adaptor sleeve as will be more fully described below. A sealing ring 90 also encircles the base to seal the adaptor sleeve with the main body. A return annulus 108 is formed between the end of the adaptor sleeve 74, the sides of bore 72, and the radial periphery of insert 78 and shim 88. Return annulus 108 communicates with return conduit 106.

The adaptor sleeve interiorly forms an enlarged receiving cavity for mounting the solenoid valve assembly 20. The solenoid valve assembly is sealingly received in the cavity and captured by the adaptor sleeve by means of a retainer shoulder 92. A mounting nut (not illustrated) may also be employed to secure the solenoid valve assembly to the adaptor sleeve. A seal ring 110 encircles the solenoid valve assembly and seals with the wall of the adaptor sleeve receiving cavity to provide a fluid tight seal between the solenoid valve assembly and the adaptor sleeve. A central release chamber 84 is formed at the interior of the adaptor sleeve. A return passage 94 formed in the adaptor sleeve communicates between the spill chamber 84 and the return annulus 108 for returning low pressure fuel vented from the control chamber to the injection system.

The solenoid valve assembly 20 comprises an electrical solenoid including a coil 96 which upon energization is adapted for magnetic interaction for attracting an axially movable armature 98. Energization of coil 96 is controlled by an electronic controller (not illustrated) which receives input signals from an engine timing sensor and other engine operating sensors such as sensors for sensing engine coolant temperature, engine speed, engine inlet manifold pressure, throttle position and supply pressure. The processor includes a data processor and provides output pulses which energize the solenoid in accordance with received engine operation data and stored data to control fuel injection pressure, fuel injection timing, and duration of solenoid energization in accordance with the solenoid operation pulse width.

The armature 98 controls the position of a pilot valve 100 which is sealingly engageable with the end of insert 78 at orifice 82 to prevent the passage or release of pressurized fuel from the first and second bleed passages and thereby maintain the pressure in control chamber 54. The pilot valve 100 is an elongated member having at one end a rigid seal surface 101 and a generally cylindrical body received in the axial control bore of the adaptor sleeve for restricted axial movement therein. The armature is constructed from a soft ferro-metallic material for enhanced magnetic characteristics. The pilot valve is constructed from a hard metallic material to enhance the sealing qualities of the valve as well as to reduce wear. An end of the pilot valve is received in a central recess of the armature in a shrink fit engagement. The clearance between the pilot valve and the sleeve is sufficient to allow the armature pilot valve assembly to float to enhance the sealing of surface 101 at orifice 82. The pilot valve 100 forms an axial bore 114 which radially communicates via radial bore 115 with a release chamber 116 formed in the axial bore of the adaptor sleeve between opposing ends of insert 78 and pilot valve 100.

An adjustable spring 102 engages the armature/pilot valve assembly to normally bias the valve surface 101 into a sealing engagement with the end of the insert for closing off the orifice 82 thereby preventing the release of fuel from the control chamber. The biasing force of the spring may be adjusted by means of a threadable adjustment screw 104. Upon energization of the coil, the armature 98 retracts to withdraw the pilot valve from sealing engagement with the end of the insert thus providing fluid communication between the control chamber 54 and the return conduit 106. The foregoing release path is defined by bleed passage 76, bleed passage 80, bleed orifice 82, release chamber 116, radial bore 115, axial bore 114, spill chamber 84, return passage 94, and return annulus 108. The released fuel flows from axial bore 114 through the gap between the armature and the end of the solenoid body to the spill chamber 84. This latter flow feature functions to cleanse or flush the gap by forcing particulate material or gas bubbles from the gap. Such material or gas bubbles might otherwise adversely alter the operation of the solenoid valve assembly 20.

The time interval during which the pilot valve retracts is critical to the operation of the accumulator injector. Accordingly, it is critical that the maximum armature displacement distance be precisely limited. A plurality of angularly spaced non-magnetic studs 97 project from the coil retainer to form a stop for the armature to prevent magnetic locking of the armature at the axial retracted position. Thus, the maximum armature displacement distance is equivalent to the distance dimension of gap G which is defined as the axial distance between the armature position when the pilot valve 100 seals orifice 82 and the armature position when the armature engages the ends of studs 97. In order to provide the proper dimension to the gap G or the maximum armature retraction distance, the thickness of shim 88 is selectively dimensioned. The foregoing described insert/adaptor sleeve configuration provides a construction whereby shim 88 effectively governs the distance of the end of the insert relative to the armature to thereby provide the desired gap.

A feature of the present invention is the provision whereby the solenoid valve assembly may be relatively easily removed from the accumulator injector by threadably unscrewing the adaptor sleeve and withdrawing the adaptor sleeve/solenoid valve assembly from the main body without requiring that the entire injector unit be disassembled or removed from the engine. The exacting dimensional relationship between the pilot valve withdrawal and the end of the insert which is required for proper operation of the solenoid valve assembly is maintained by means of an appropriately dimensioned shim 88 even though there may be gap variations between individual solenoid valve assemblies due to variations in the manner with which the assemblies are mounted or due to variations within the solenoid valve assemblies.

In operation, fuel under rail pressure flows through inlet bore 22 via orifice 66 and accumulator passage 64 to the auxiliary accumulator chamber 70. The accumulated pressurized fuel flows from the auxiliary chamber via transfer passage 68 to the nozzle chamber 44. The pressurized fuel in the inlet bore also flows via inlet passage 30 and inlet orifice 32 to the control chamber 54. The pressure in the control chamber acting against the plunger of the valve needle together with the light compression force of spring 48 normally forces the valve needle to seat against the seat of the nozzle thus closing the discharge orifices 38 to the passage of pressurized fuel.

Upon selective energization of the coil of the solenoid valve assembly for a selected short interval determined by the operating width of a pulse to the solenoid, the pilot valve surface 101 is momentarily retracted from the bleed orifice 82 venting the bleed orifice and the fuel in the control chamber to the return passage. The venting of the pressurized fuel in the control chamber results in a sharp decrease in pressure in the control chamber to a level below the pressure in the accumulator chamber for triggering the injection event. The pressure decrease causes the valve needle to axially retract under the relatively higher pressure of the fuel in the nozzle chamber 44 due to the differential pressure area which results from the diameter of the plunger 52 being greater than the diameter of the valve seat 40. The retraction of the valve needle, whereby the needle momentarily lifts from the conical seat, results in the injection of pressurized fuel through the discharge orifices 38 into the combustion space of the associated engine.

The de-energization of the solenoid coil allows the pilot valve to return to the closed sealing position at orifice 82 under the bias of spring 102, thus resulting in rapid pressurization of the control chamber 54. The pressurization of the control chamber together with the bias force of the spring 48 rapidly overcomes the opposing residual pressure in the accumulator chamber to rapidly return the valve needle into sealing engagement with the conical seat 40. The inlet flow of pressurized fuel to the accumulator chamber is relatively small during the injection event due to the restricted accumulator inlet orifice 66. The orifices 82 and 32 are dimensioned so that there is a greater release of pressurized fuel through the bleed passages to the return passage than the inlet fuel flow to the control chamber during the injection event.

The fuel in the accumulator and valve chambers is pressurized to the high rail pressure in between injection events. The volume of the auxiliary accumulator and valve chambers substantially exceeds the volume of the injected fuel charge (depending in part on the volume of accumulator cap 58). The accumulator pressure decreases to a level significantly below that of the rail pressure during the fuel injection event due to the dimensional relationship between the accumulator inlet orifice 66 and the discharge orifices 38. Therefore, when the solenoid valve is de-energized, the rapid increase of pressure in the control chamber results in the rapid reseating of the valve needle to provide an abrupt termination of fuel injection and thereby prevent fuel dribble or throttling and provide favorable fuel atomization characteristics.

Figure 2:
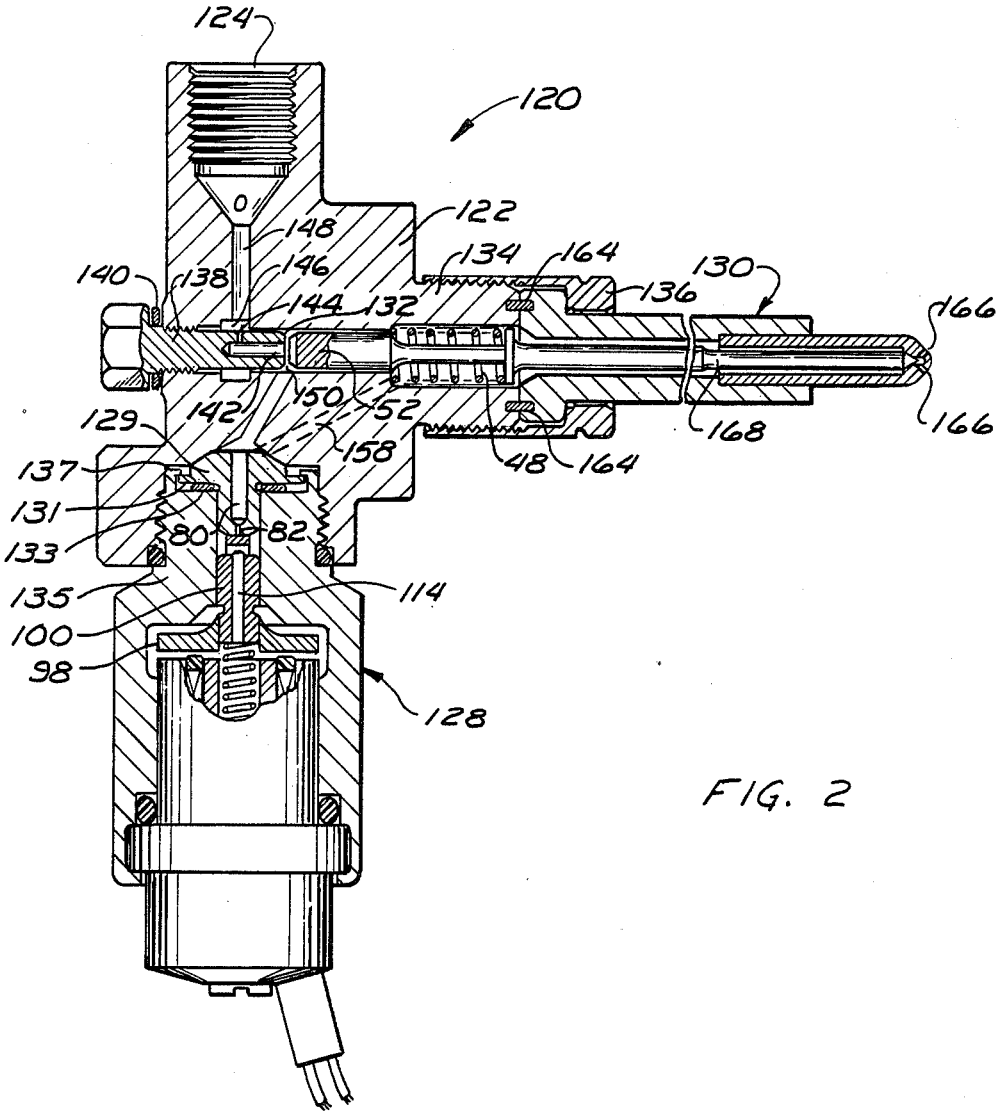
FIG. 2 is an axial sectional view, partly in section and partly broken away, of an alternate embodiment of an accumulator injector of the present invention.
Figure 3:
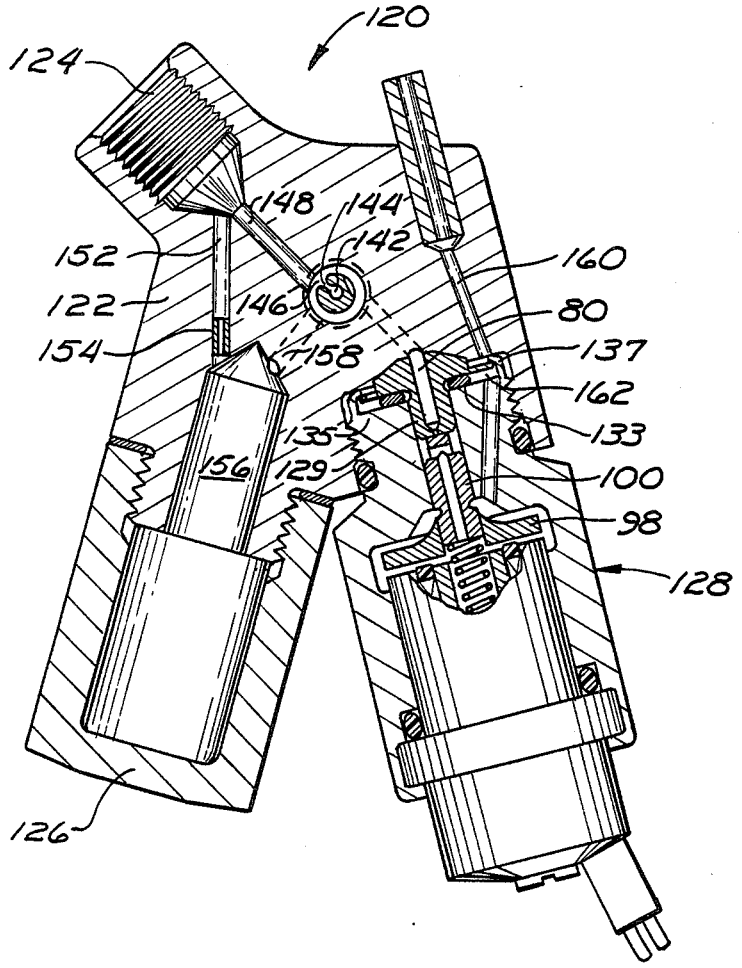
FIG. 3 is a cross-sectional view of the accumulator injector of FIG. 2 taken along the line 3—3.

With reference to FIGS. 2 and 3, an alternative embodiment of an accumulator injector in accordance with the present invention is generally designated by the numeral 120. Accumulator injector 120 primarily differs from accumulator injector 10 in terms of the configuration of the main body 122 and the relative dispositions of the inlet bore 124, the accumulator 126, the solenoid valve assembly 128 and the nozzle 130.

With specific reference to FIG. 2, the main body 122 is configured so that the inlet bore 124 generally aligns with the solenoid valve assembly 128 with the displacement axis of the nozzle 130 being generally at right angles to the foregoing inlet bore and solenoid valve assembly. The main body 122 forms a dual stepped bore 132 which receives the plunger 52 of the nozzle and includes an enlarged outer portion for receiving the return spring 48 of the nozzle. The main body has a protruding annular shoulder 134 which is exteriorly threaded for threadably receiving a mounting nut 136. Mounting nut 136 captures the base portion of the nozzle for securing the nozzle to the main body. A plug 138 is threaded into the axial bore 132 and is sealed in fluid tight relationship with the main body. Plug 138 is tightened against an annular shim 140 at the main body exterior. Plug 138 forms at an inner end an axial passage 142 which radially communicates via a restricted passage 144 with an inlet annulus 146 formed in the main body. In a manner analogous to that described for accumulator injector 10, fuel at rail pressure enters inlet bore 124 and flows via inlet passage 148, inlet annulus 146, restricted passage 144 and axial passage 142 for reception in control chamber 150 formed in the axial bore of the main body.

A pair of locating pins 164 connect between the abutting ends of the nozzle body and annular shoulder 134 of the main body to provide a means for accurately fixing the angular orientation of the discharge orifices 166 of the nozzle. The coupling nut mounting configuration as illustrated in FIG. 2 provides a means whereby the angular orientation of the discharge orifices may be precisely fixed. The thickness of plug shim 140 governs the maximum lift or the maximum displacement distance of valve needle 168.

An accumulator passage 152 extends from the inlet bore 124 at an oblique angle to the inlet passage 148. Accumulator passage includes a restriction 154 providing a restricted passage into an accumulator reservoir 156 formed in the main body. An accumulator cap is threaded to the main body to form an auxiliary accumulator chamber as described with respect to the accumulator injector 10. It should be appreciated (as illustrated in FIG. 2) that the auxiliary accumulator chamber is angularly disposed in close proximity to the removable solenoid valve assembly. A nozzle passage 158 extends from the accumulator reservoir for communication with the valve chamber of the nozzle. The main body includes a return passage 160 which communicates with a return annulus 162 for returning released fluid to the injection system.

Solenoid valve assembly 128 is a composite preadjusted solenoid valve unit. The received insert 129 has a laterally projecting engagement rim 131. A shim 133 which defines the retraction gap of the solenoid valve is captured between the underside of the rim 131 and the adaptor sleeve 135. A lateral retention shoulder 137 extends from the adaptor sleeve to inwardly engage rim 131 for securing the insert and shim to the adaptor sleeve in fixed relationship. The remaining components of accumulator injector 120 are substantially identical to those described for accumulator injector 10 and function substantially in the same manner and will not be described in further detail.

Figure 4:
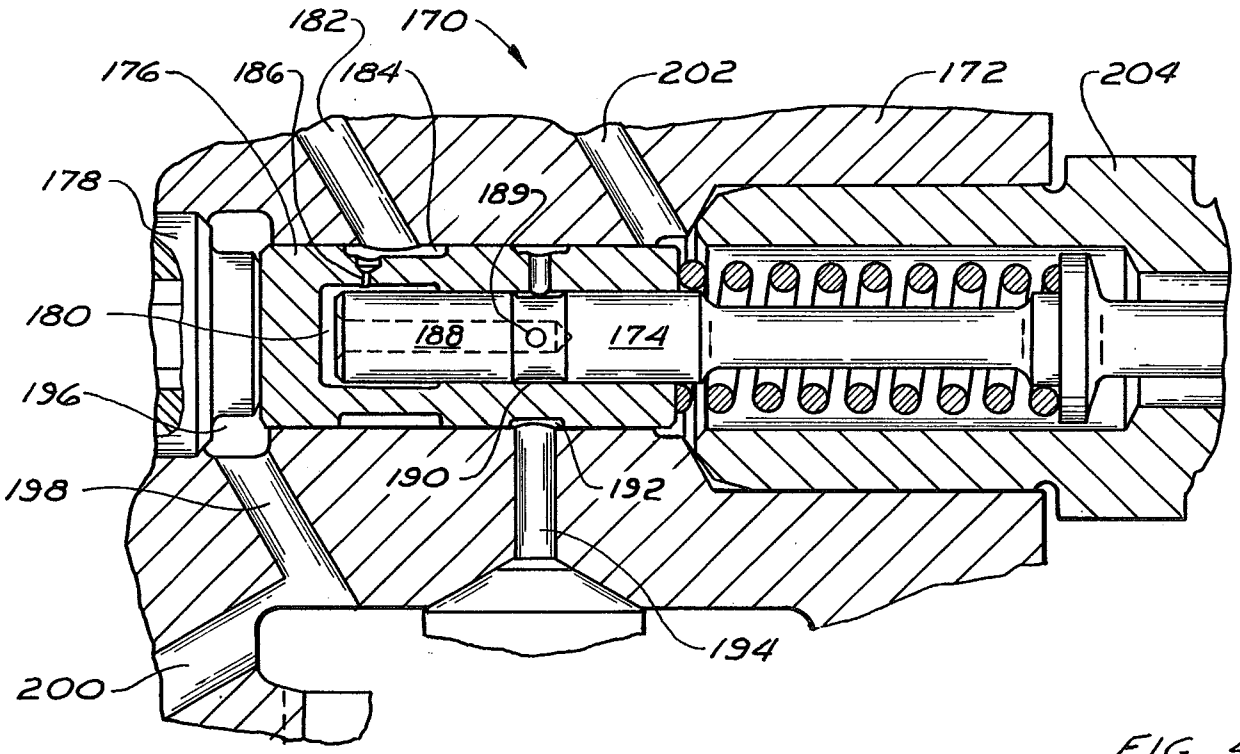
FIG. 4 is an enlarged fragmentary axial sectional view, partly in section and partly broken away, of a second alternate embodiment of an accumulator injector of the present invention.

With reference to FIG. 4, a second alternative embodiment of an accumulator injector in accordance with the present invention is generally designated by the numeral 170. Accumulator injector 170 primarily differs from the foregoing described injectors in terms of the configurations of the control chamber and the inlet supply passages formed in the main body member 172 as well as the configuration of the plunger 174 of the nozzle. An insert sleeve 176 is received in the main body 172 and secured therein by means of a retaining member 178 threaded into the main body. Insert sleeve 176 is a generally cup-shaped member which receives the plunger and interiorly forms control chamber 180. Fuel at rail pressure flows to control chamber 180 via an inlet passage 182 formed in the main body, an annulus 184 formed between the insert sleeve 176 and the bore of the main body, and a restricted passage 186.

The plunger includes an axial bore 188 which leads from the control chamber 180 via a radial bore 189 to a circumferentially extending annulus 190 formed between the plunger and the insert sleeve. Annulus 190 radially communicates with a second annulus 192 formed at the exterior of insert sleeve 176 for communicating with bleed passage 194. The release of fuel through bleed passage 194 is controlled in a manner analogous to that previously described for accumulator injector 10. The bleed path leads from control chamber 180 via axial passage 188, radial bore 189, annulus 190 and annulus 192 to the bleed passage 194. A return annulus 196 is also formed in the main body between the end of insert sleeve 176 and retainer element 178 to provide a leak path via return passage 198 and return conduit 200 for returning fuel. An auxiliary accumulator chamber formed by a modular cap may also be employed for supplying pressurized fuel via passage 202 to the valve chamber of the nozzle 204. It should be appreciated that accumulator injector 170 provides a reduced axial dimension to facilitate the accommodation of the accumulator injector in the internal combustion engine. In addition accumulator injector 170 provides a relatively small dead volume for control chamber 180 thereby decreasing the response time interval between the actuation of the solenoid valve and the fuel injection event.

Figure 5:
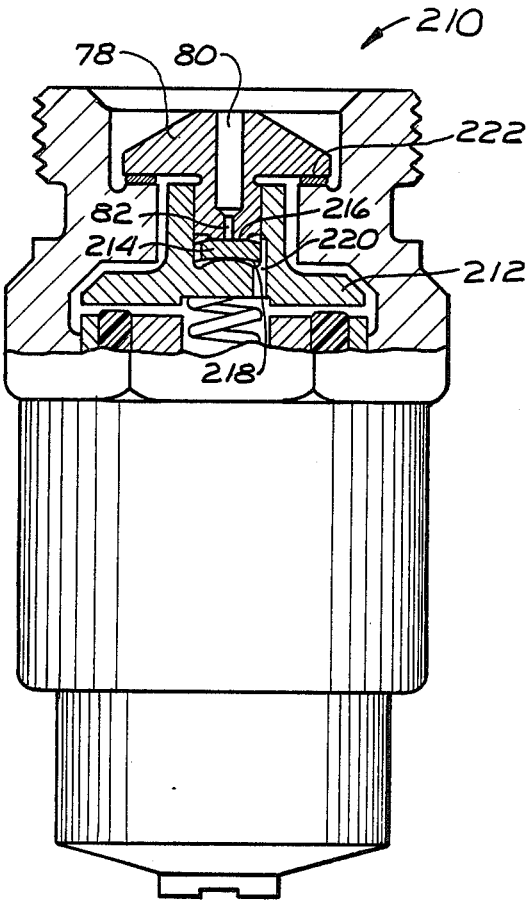
FIG. 5 is an enlarged fragmentary axial sectional view, partly in section and partly broken away, of an alternative embodiment of a solenoid valve assembly for the accumulator injector of the present invention.

With reference to FIG. 5, an alternative embodiment of a solenoid valve assembly which may be employed in accumulator injector 10, 120 and 170 is generally designated by the numeral 210. A sintered steel armature 212 forms a sleeve for receiving the insert 78 and a floating valve member 214. The floating member 214 has a substantially flat central sealing surface 216 and a slightly curved opposite surface 218. The armature includes a central curved portion which interacts against the curved surface of the valve member to provide a self-centering or self-aligning orientation means so that the valve member may be rigidly uniformly sealed a bleed orifice 82. The valve member may be of a generally bi-concave disc-like form having a plurality of angular spaced peripheral notches to facilitate fluid communication from the bleed passage 80 via passage 220 formed in the armature when the solenoid valve is actuated for retraction of the armature 212 to release pressure in the control chamber. Alternately, the bottom of the armature member may be flat and the bottom portion of the sealing member may be rounded to also provide for the self-aligning feature. When the solenoid valve is actuated for retraction of the armature, the valve member essentially floats within the receptacle formed by the armature. The solenoid valve assembly 210 allows for a shorter axial dimension to the valve assembly in addition to providing the self-aligning feature as described. Shim 222 is selectively dimensioned to provide the desired retraction gap between the armature and the solenoid body as previously described.

It should be appreciated that a feature of the foregoing accumulator injector is the provision of a modular-type accumulator injector wherein the volume of the accumulator chamber may be relatively easily modified by selecting an accumulator cap and substituting the selected cap in the injector unit. In addition, the solenoid valve assembly may be relatively easily removed. In the event of electrical or mechanical problems in the solenoid unit the solenoid unit may be replaced by another pre-adjusted unit without removing the entire accumulator injector from the engine or disassembling the injector. The injector in accordance with the invention makes possible the incorporation of numerous interchangeable common components for different applications and configurations.

While a preferred embodiment of the foregoing invention has been set forth for purposes of illustration, the foregoing description should not be deemed a limitation of the invention herein. Accordingly, various modifications, adaptations and alternatives may occur to one skilled in the art without departing from the spirit and scope of the present invention.

What is claimed is:

1. An accumulator injector for a fuel injection system comprising:

body means forming a control chamber, a bleed passage from said control chamber, and an accumulator passage to receive fuel at rail pressure and transfer said fuel to said control chamber and said accumulator passage;

nozzle means mounted to said body means to receive pressurized fuel from said accumulator passage and to inject pressurized fuel, said nozzle means comprising discharge orifice means, a valve seat and an elongated valve needle engageable with said valve seat in response to pressure in said control chamber to prevent the passage of pressurized fuel through said discharge orifice means and momentarily axially displaceable from said seat for injecting pressurized fuel through said discharge orifice means;

auxiliary accumulator chamber means comprising a cap threadably removably mounted to said body means at the exterior thereof, said cap at least partially defining an auxiliary accumulator chamber communicating with said accumulator passage and said nozzle means to accumulate pressurized fuel;

adaptor means for removable mounting to said body means, said adaptor means forming a receiving cavity and fuel return means communicable with said bleed passage; and solenoid valve means received in said receiving cavity and mounted to said adaptor means to selectively vent said bleed passage for communication with said fuel return means so that energization of said solenoid valve means causes a release of pressure from said control chamber and the momentary axial displacement of said valve needle to inject a discrete charge of pressurized fuel through said discharge orifice means.

2. An accumulator injector for a fuel injection system comprising:

body means forming a control chamber, a bleed passage from said control chamber, and an accumulator passage to receive fuel at rail pressure and transfer said fuel to said control chamber and said accumulator passage;

nozzle means mounted to said body means to receive pressurized fuel from said accumulator passage and to inject pressurized fuel, said nozzle means comprising orifice discharge means, a valve seat and an elongated valve needle engageable with said valve seat in response to pressure in said control chamber to prevent the passage of pressurized fuel through said discharge orifice means and momentarily axially displaceable from said valve seat for injecting pressurized fuel through said discharge orifice means;

auxiliary accumulator chamber means comprising a cap threadably removably mounted to said body means at the exterior thereof, said cap at least partially defining an auxiliary accumulator chamber communicating with said accumulator passage and said nozzle means to accumulate pressurized fuel; and solenoid valve means to selectively vent said bleed passage so that energization of said solenoid valve means causes a release of pressure from said control chamber and the momentary axial displacement of said valve needle to inject a discrete charge of pressurized fuel through said discharge orifice means.

3. An accumulator injector for a fuel injection system comprising:

body mean forming a control chamber, a bleed passage from said control chamber, and an accumulator passage to receive fuel at rail pressure and transfer said fuel to said control chamber and said accumulator passage, said body means defining a cavity at least partially defined by a threaded surface;

nozzle means mounted to said body means to receive pressurized fuel from said accumulator passage and to inject pressurized fuel, said nozzle means comprising discharge orifice means, a valve seat and an elongated valve needle engageable with said valve seat in response to pressure in said control chamber to prevent the passage of fuel through said discharge orifice means and momentarily axially displaceable from said seat for injecting pressurized fuel through said discharge orifice means;

solenoid valve means to selectively vent said bleed passage so that pressure in said control chamber is released and said valve needle is displaced to inject a discrete charge of pressurized fuel through said discharge orifice means; and mounting means comprising an adaptor sleeve forming a receiving cavity for receiving said solenoid valve means to removably mount said solenoid valve means to said body means, said adaptor sleeve received in said body means cavity and having an exterior threaded surface which threadably engages the threaded surface of said body means.

4. The accumulator injector of claim 1 wherein said auxiliary accumulator chamber means and said solenoid valve means are generally disposed at right angles to the displacement axis of said valve needle.

5. The accumulator injector of claim 1 wherein said solenoid valve means comprises a solenoid including a coil and an armature, and a pilot valve governed by said armature, said armature being normally spring biased to a first position and being retractable to a second position upon energization of said coil, said retracting distance defining a gap.

6. The accumulator injector of claim 5 further comprising a shim positionable against said adaptor means wherein the dimensions of the shim at least partially define the dimensions of said gap.

7. The accumulator injector of claim 1 further comprising an inlet insert received by said body means, said inlet insert forming an inlet passage leading to said control chamber, an inlet orifice being interposed in said inlet passage.

8. The accumulator injector of claim 7 further comprising an outlet insert member disposed between said body means and said adaptor means, said outlet insert forming a seal with said body means along a generally frusto-conical surface and forming a second bleed passage communicating with said first bleed passage, a bleed orifice being disposed in said second bleed passage, the diameter of said bleed orifice being dimensioned in accordance with the diameter of the inlet orifice.

9. The accumulator injector of claim 2 wherein said cap member is generally cylindrically shaped and is interiorly threaded for mounting to said body means.

10. The accumulator injector of claim 3 wherein said adaptor sleeve further defines a second bleed passage interposed by a bleed orifice and said solenoid valve means includes a pilot valve which is sealingly engageable at said orifice to selectively close the orifice to the passage of fuel from said second bleed passage.

11. The accumulator injector of claim 3 wherein solenoid valve means further comprises a solenoid body and an armature axially displaceable relative to said body with the position of said pilot valve being governed by the armature and wherein the energization of said solenoid valve means retracts the pilot valve to a second position displaced from said discharge orifice.

12. The accumulator injector of claim 11 wherein the pilot valve further comprises an axial return passage which selectively communicates with the second bleed passage so that fuel released from said second bleed passage passes between the armature and the solenoid body.

13. The accumulator injector of claim 11 wherein the distance between the first position and the second position of said pilot valve is at least partially defined by means of a shim engageable against the end of the adaptor sleeve.

14. The accumulator injector of claim 1 wherein the control chamber is defined by a plug member threaded into a bore in said body means, and the maximum displacement of said valve needle is defined by the axial position of said plug member.

15. The accumulator injector of claim 1 wherein said valve needle has a control portion which is received in said control chamber, said control portion forming an axial bore, a radial passage, and an annulus communicating with said bleed passage.

16. The accumulator injector of claim 15 further comprising a sleeve which forms said control chamber and receives said control portion, said sleeve forming a passage for communication between the control portion annulus and the bleed passage.

17. The accumulator injector of claim 3 wherein said solenoid valve means comprises an armature forming a receptacle and a sealing element received in said receptacle in floating relationship therewith.

18. The accumulator injector of claim 3 wherein the solenoid valve means comprises:

a solenoid body including a coil;

an armature magnetically attractable upon energization of said coil for axial movement; and a valve member connecting said armature and forming a sealing surface and an interior passage to provide fluid communication between said armature and solenoid body.

19. The accumulator injector of claim 1 wherein said cap is generally cylindrically shaped with a generally annular end surface, a sealing ring being sealingly interposed between said end surface and said body means.

20. The accumulator injector of claim 1 further comprising a plurality of caps each threadably removably mountable at the exterior of said body means to at least partially define an auxiliary accumulator chamber having a unique volume.

21. The accumulator injector of claim 2 further comprising a plurality of caps each threadably removably mountable at the exterior of said body means to at least partially define an auxiliary accumulator chamber having a unique volume.

* * * * *